US009486061B1

(12) United States Patent
Rosenberg et al.

(10) Patent No.: US 9,486,061 B1
(45) Date of Patent: Nov. 8, 2016

(54) OPTIBRUSHER

(71) Applicant: Audrey Rosenberg, Westport, CT (US)

(72) Inventors: Audrey Rosenberg, Westport, CT (US); Jack Rosenberg, Westport, CT (US)

( * ) Notice: Subject to any disclaimer, the term of this patent is extended or adjusted under 35 U.S.C. 154(b) by 152 days.

(21) Appl. No.: 14/485,776

(22) Filed: Sep. 14, 2014

Related U.S. Application Data

(63) Continuation-in-part of application No. 13/831,356, filed on Mar. 14, 2013, now abandoned.

(51) Int. Cl.
*A46B 9/04* (2006.01)

(52) U.S. Cl.
CPC ..... *A46B 9/045* (2013.01)

(58) Field of Classification Search
CPC ..... A46B 9/045; A46B 9/026
USPC ..... 15/167.2
See application file for complete search history.

(56) References Cited

U.S. PATENT DOCUMENTS 1,707,118 A * 3/1929 Goldberg ..... A46B 9/045 15/110
5,615,443 A * 4/1997 Lai ..... A46B 9/045 15/145
8,292,624 B2 * 10/2012 Gallagher, Jr. .... A46B 11/0003 433/216

* cited by examiner

*Primary Examiner* — Laura C Guidotti
(74) *Attorney, Agent, or Firm* — Ziegler IP Law Group, LLC

(57) ABSTRACT

A tooth brush appliance includes a frame including an upper arch member and a lower arch member configured to receive teeth, the upper arch member and lower arch member including bristle members; an inner sidewall and an outer sidewall of the upper arch member including one or more openings, the one or more openings defining channels extending through the inner sidewall and outer sidewall of the upper arch member, an inner sidewall and an outer sidewall of the lower arch member including one or more openings, the one or more openings defining channels extending through the inner sidewall and outer sidewall of the lower arch member.

17 Claims, 5 Drawing Sheets

OPTIBRUSHER

This application is a continuation in part of application Ser. No. 13/831,356 Rosenberg et al 2013, the disclosure of which is incorporated herein by reference in its entirety.

FIELD OF DISCLOSURE

The aspects of the present disclosure encompass the field of oral appliances for brushing teeth, and dental hygiene.

BACKGROUND

There has always been a difficulty for disabled, and elderly patents to maintain a healthy dentition. Thus, constantly maintaining gingivitis, constant infection and risk for heart disease as well as constant cavities, which leads to dental problems such as root canals, and extractions. Having a full mouth toothbrush, that one just needs to chew on, to get a gingival massage and plaque removal, is a simple solution for the needs of those that cannot use an electric toothbrush (pacemaker patients), hospital bound, Arthritis and Stroke stricken, elderly, autistic, developmentally challenged, to name a few or anyone who may want a quick brush. In recent discussions with a quality control nurse who's charges are profoundly developmental challenged patients. She disclosed to me that the dental care of similar patents consisted of extractions. By the time the patients are in their twenties, they have few remaining teeth. Because finances are tight for most of the families and fitting dentures is next to impossible these patients go with out teeth reducing their diets to either baby food or food that can be pureed. One particular case where the teeth were removed the patient died with two years. It would be nice to provide some intervention and prevention of decay. These patients were also medically compromised, a caseworker does not brush teeth; therefore the patients are constantly introducing bacteria into their blood stream with gingival inflammation and bleeding.

While full mouth brushes are available, these do not allow proper cleaning and drying. Without proper cleaning and drying of the appliance, bacteria and food debris will be trapped, and bacteria will be reintroduced into the mouth, continuing infection and disease, the food debris will become rancid, and without proper air flow to allow for the appliance to dry, mold will grow within hours of use. As a dental hygienist for over 40 years, one of the first things we learn about toothbrushes is that they need to be cleaned and dried between uses to prevent microbial growth. Flood victims have learned that mold will start growing in 6 hours at room temperature leaving the overnight drying critical. It would be advantageous to provide a full mouth tooth brush that would allow for fluids to travel around the mouth and throughout the appliance, enable an adequate air flow through and around the appliance, while also providing gingival massage and plaque removal.

Efforts have been made to adapt the arched channel structure of a mouth guard into the function of a toothbrush that engages all the teeth at once. Some examples are found in U.S. Pat. No. 2,257,709-Anderson and, U.S. Pat. No. 4,011,616—Kennedy. The problem with such appliances with similar construction is the lack of channels through the structure walls to allow for proper airflow for drying, thus supporting the growth of microorganisms. See also U.S. Pat. Application Publication 2009/0277461 AI-Gallagher J R et al. It would be advantageous to provide a mouth guard style toothbrush that incorporates channels to enable proper air flow allowing the appliance to dry, thus prohibiting the growth of microorganisms. There is a major problem with microbial growth without the ability to clean and dry the appliance properly, as well as difficulty of the patient to deal with quantities of fluid and toothpaste in the bristles with no place for the overflow to drain. It would be advantageous to create channels that will allow excess fluid to drain and provide airflow making it functional and safe to use. Another challenge with respect to the Blizzardent product is the cost. One appliance would incur an investment of $300.00-$400.00 which is a bit excessive.

SUMMARY

An appliance configured to cover both the upper and lower teeth at the same time infused with bristles so that chewing is all that is necessary to cleanse the teeth and gums of any developmentally challenged, handicapped or any person not able to hold a toothbrush, is needed to fill the missing link in their health care needs. Because of their difficult nature, using toothpaste in any of the previous describes appliances of this nature will not work. The other appliances do not have holes, channels, spaces, or slots to allow for fluid to drain or air to flow, which prevent the patient from gagging or choking on the foaming of the toothpaste, or allowing for the appliance to dry preventing the growth of microorganisms.

Having an embodiment of this appliance will help people who cannot handle a toothbrush have the ability to cleanse their teeth and gums, and maintain a healthy dentition. The continued presence of inflammation between the teeth causes an increased number of white blood cells in the body. Having an inflamed gingival condition known as gingivitis is having an ongoing infection. If there is no resolution, the infection gets worse and there is bleeding, introducing bacterium into the bloodstream. This leads to plaque building in the blood stream, or bacterial clusters on heart defects or compromising diabetics further. Without cleansing ability the bacteria builds up around the base of the teeth compromising the health of the periodontium, this causing bone loss, and causing acids to form after eating, causing cavities. In an already compromised health condition, cavities that go unattended causing further damage and infect the tooth nerve, and in challenged patients dentistry is difficult or impossible, thus causing tooth loss. Tooth loss compromises the diet, and nutrition falters and the compromised health is further compromised. Having a brushing appliance that is generic and affordable would be a wonderful thing to improve the health, and comfort of anyone who has trouble holding a toothbrush as well as anyone who would like a fast way to brush, or perhaps people who can't get to a sink to use water, campers or military. Being able to brush will increase the comfort of the user.

Channels connecting through the structure sides and biting surfaces are needed in this embodiment to promote proper hygiene. It will prevent microbial growth in the device. Holes, spaces, slots, that connect the inside and outside of the appliance walls creating channels allowing fluid to drain will help users deal more comfortably with saliva, toothpaste or mouthwash, which might otherwise cause gagging.

DESCRIPTION OF THE DRAWINGS

Embodiments of the aspects of the present disclosure will now be described, by way of example only, with reference to the following diagrams, wherein.

DETAILED DESCRIPTION

Figure 1:
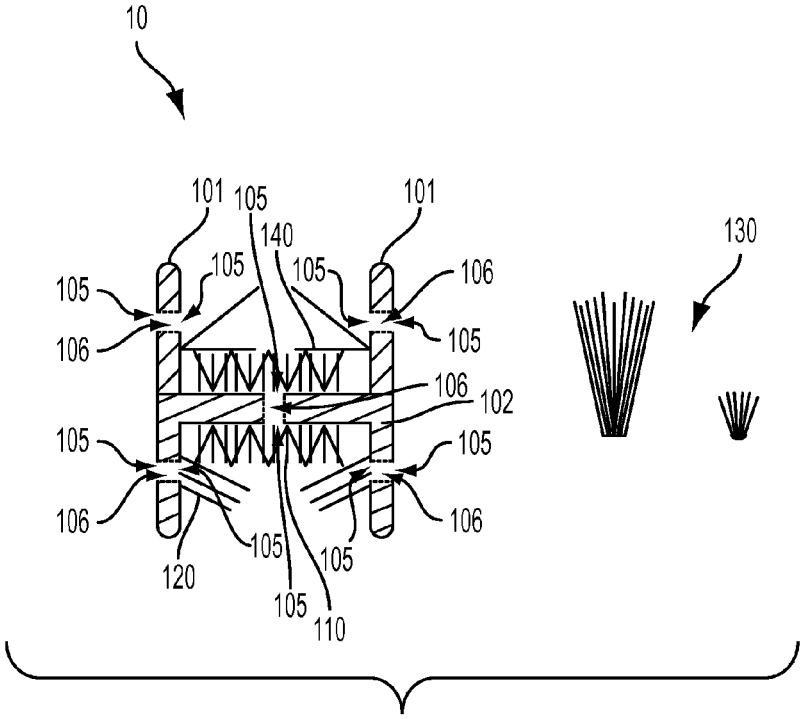
FIG. 1 illustrates one embodiment of an oral appliance incorportating aspects of the present disclosure.

In one embodiment the invention encompasses an oral appliance as shown in FIGS. 1 through 10, composed and configured as a full mouth cleaner operated by a chewing motion. For this purpose the appliance is formed with upper and lower bite members or channels having inwardly fused tufts of bristles for cleaning the teeth and massaging the gingiva.

The general shape of the appliance resembles that of an athletic mouth guard, having two members or channels, also referred to herein as upper and lower arches, generally following the dental arches, disposed opposite from one an other so that the respective upper and lower arches accept the teeth of the maxillary and mandibular arch.

In one embodiment, the appliance includes openings that form channels through the walls of the appliance. The openings that form channels can also be referred to as spaces, slots, pores or holes, for example. The openings in the appliance walls form channels that connect the outer walls of the appliance to the inner space of the upper and lower arches. These channels can be any size or shape, and any array or configuration suitable spaced so that the structure of the appliance is not compromised. The channels are configured to create drainage or flow pathways to enable enough air and fluid flow in and around the appliance. The channels in the appliance allow for the use of edible mouthwash, or fluoridated mouthwash in place of toothpaste. Having channels throughout the appliance allows for drainage so the user will not choke on large amounts of foam created by brushing/chewing. The channels can be placed at an angle or can be any size or shape, like a cookie cutter cut out, which will allow proper function without compromising the structure. The channels can be configured to extend through any of the walls of the appliance, including the substantially vertical walls of the upper and lower arches, as well as the substantially horizontal member or bite surface, between the upper and lower arches. Having channels located throughout the structure located on the sides and between the arches, also allows the user to use a minimal amount of mouth wash instead of toothpaste. Toothpaste is very bulky and will cause a foaming with chewing/brushing, which can cause some users to gag. By being able to use a few drops of mouth wash, placed in the appliance, by chewing and using the biting action the channels will allow the saliva to carry the mouthwash around all the teeth without an overabundance of mouthwash or toothpaste causing gagging.

The channels are located throughout the appliance and not just in one area. The openings and channels can be staggered, arranged at predetermined spaced apart intervals, or arranged randomly. There should be enough opening and channels to provide for adequate fluid flow and drainage in and around the appliance. Bristles will be interspersed and all teeth will be brushed, so all teeth will be able to benefit. All portions of the appliance will be able to be rinses properly and dried thoroughly. Construction will be composed of FDA approved material, using a molded or injected form infused with bristles. The appliance can be reusable. The generic brush can be made in 3 sizes, small, medium and large, so children and adolescence can use the appliance. It will have a handle for easy administration. The handle is made of the same material as the appliance and is an extension of the structure. It is a large oval shape with perforations in the center of the oval shape so that it can be conformed into 3 conversions. The handle will be thick enough to grasp, and thin enough so it would not be obtrusive, or too thick so that the perforations cannot be used to determine the size of the handle. The handle can be determined by removing the portion not needed, by popping of the perforated portion, so the middle section can be removed to allow for a thumb or a finger to be inserted for patients that cannot grasp a smaller grip, and if not needed the outer portion can be removed.

Customizing can be achieved by having a single arch design and fusing the separate arches lining up the channels in difficult dentitions.

FIG. 1 End View

FIG. 1 illustrates an end view of one embodiment of a tooth brushing appliance 10 of the present disclosure. The basic structural component or frame 100 of the appliance 10 is in the form of an "H" frame. The frame 100 includes side walls 101 and a connecting member 102, also referred to as the bite surface. In one embodiment, the side walls 101 and the connecting member 102 includes openings 105. The openings 105 are on either side of the side walls 101 and connecting member 102 and extend through the side walls 101 and the connecting member 102 to form channels, generally shown as 106.

The channels 106 provide for the flow of fluid and air as is generally described herein. Although a H-shaped structure is shown in FIG. 1, in alternate embodiments, any suitable shape for the structural component or frame 100 can be considered.

Figure 4:
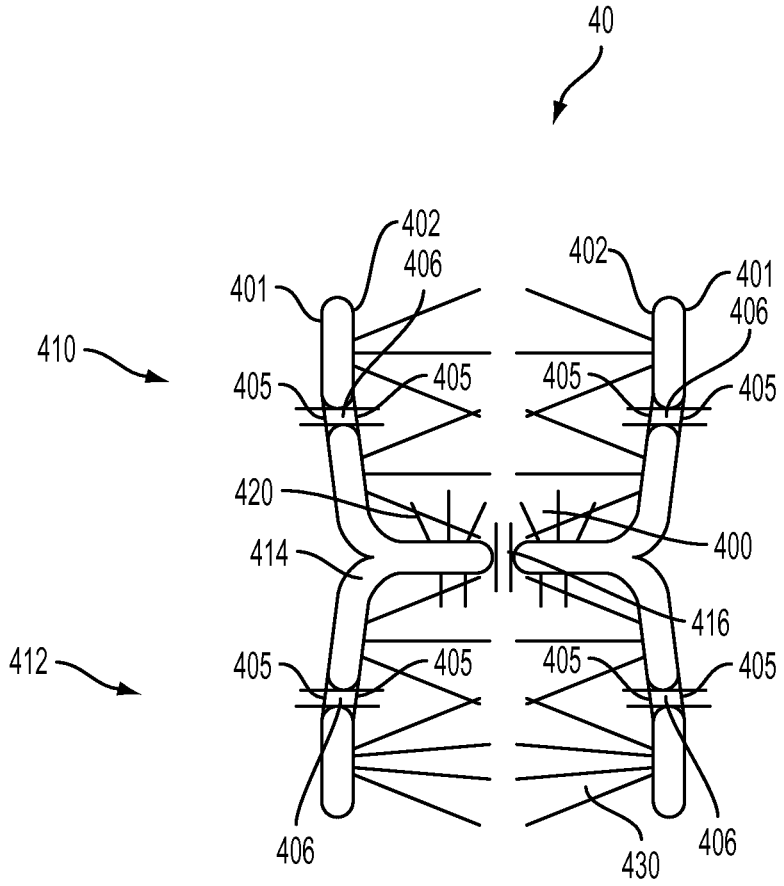
FIG. 4 illustrates an end view of one embodiment of an appliance incorporating aspects of the present disclosure.

For example, FIG. 4 illustrates a substantially "U" shape structural component or frame 400. The U shaped frame 400 of FIG. 4 shows openings 405 going through the walls 401 of the frame 400 creating channels 406. While a V-shape frame could be considered, a V-shaped frame, due to it shape, would likely support the growth of microorganisms.

Generally, the structure or frame 100 of the appliance will be made of FDA approved materials, either molded or injected pliable material that can be made in many colors, or single color, can use identifying indelible markers for patient identification, and all sides having infused bristle tufts and channels so that air and fluids can flow throughout the appliance 10. This enables proper cleaning and drying and resists the growth of bacteria.

In one embodiment, the appliance 10 shown in FIG. 1 includes bristles 110 and 120. Bristles 110 are shorter bristles for the biting surfaces or connecting member 102

Bristles 120 are longer bristle. In one embodiment, the longer bristles 120 are in the form of tufts lining the sides of the appliance.

Bristles 130 are two lengths of bristle tufts

Figure 2:
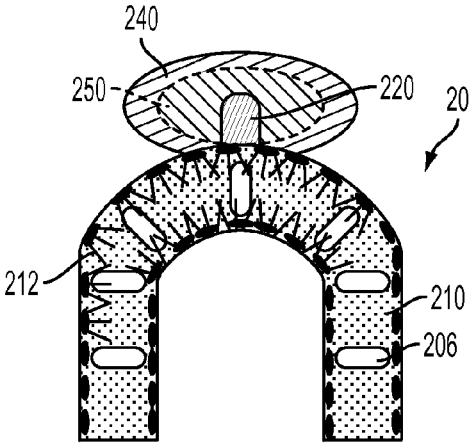
FIG. 2 illustrates a top view of one embodiment of an oral appliance of the present disclosure.

Bristles 140 representing bristle tufts, that can be placed in many direction FIG. 2 illustrates a top view of one embodiment of the tooth brushing appliance 20 of the present disclosure. In this example, the appliance 20 is made of molded soft pliable plastic or injected FDA approved material, with rounded edges, can be made of rubber, or any material that is pliable and non toxic, yet durable for many uses, or just for a single use. The appliance 20 includes channels 206 between the arches that extend through the structure creating channels for air and fluid to flow. The channels 206 allow for proper drying of the appliance 20 so mold will not form, and excess fluid to drain to. Suitable spacing of the channels 206 reasonably placed for airflow allows for proper maintenance and care for the appliance 20. Without channels 206 mold will start to form in a matter of hours, and it will no longer be sanitary. Channels 206 in the appliance 20 allows for the use of edible mouthwash, or fluoridated mouthwash in place of toothpaste. Having channels 206 throughout the appliance 20 allows for drainage so the user will not choke on large amounts of foam created by brushing/chewing. The channels 206 can be placed at an angle or can be any size or shape, like a cookie cutter cut out, which will allow proper function without compromising the structure of the appliance 20. The dots 210 represent the smaller bristle tufts located throughout the biting surface.

The appliance 20 includes enough bristle tufts 212 in many directions so that all teeth can be brushed and the channels 206 will not prevent the corresponding areas from being brushed. In one embodiment, a thumb grip handle 220 is provided, the inside portion of the handle 220 for those that can use the grasping motions. A health care worker or family member can use for administration if the patient cannot use their hands; smaller handle is less obtrusive and less aped to be jostled. This also is perforated and can be removed.

3. The handle is made in a large oval shape with 2 different perforated sections defined. Any one of these perforated sections can be popped out so that it will accommodate someone that would need to insert a finger or two to get hold of or a smaller grip to be less obtrusive to prevent jostling with a health care user or a person that can use a thumb grasp. This section can be removed to allow a stroke patient to use.

4. The outer most section of the handle can be removed, or retained and have the inside removed for easier handling.

5. Appliance can be made with just the smaller handle.

FIG. 3 Side View

Figure 3:
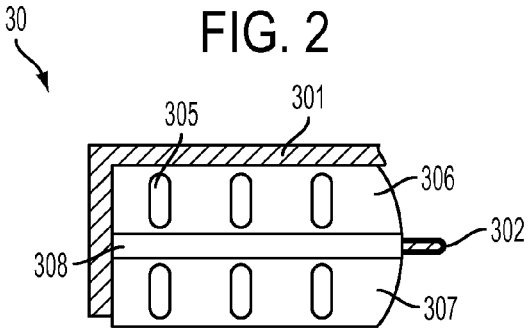
FIG. 3 illustrates a side view of one embodiment of an oral appliance of the present disclosure.

This shows the side view of an appliance 30 incorporating aspects of the present disclosure. The appliance 30 allows for both upper and lower teeth to engage with the bristles at the same time. Channels 305 in the walls 301 of the appliance 30 allow for communication of fluids between the mouth and teeth, allowing mouth wash to be used in place of toothpaste, and drainage of excess fluids to run off and cleaning and drying the brush, to maintain sanitary brushing conditions. In the embodiment of FIG. 3, the channels 305 are generally disposed on a horizontal plane. Air flow through the channels 305 will allow for proper drying between uses to prevent mold from forming, and keep the device sanitary between uses.

306. This is the section for the upper arch, not showing the array of bristles.

307. This is the section for the lower arch.

308. This is the biting surface that contains bristles for chewing and channels for drying which cannot be seen.

302. Smaller sized handle

FIG. 4 illustrates an end view of one embodiment of an appliance 40 incorporating aspects of the present disclosure. This view shows a "U" shaped structure 400, showing channels 406 extending through the outer 401 and inner 402 walls and channel(s) 416 connecting or communicating with the upper 410 and lower 412 arches across or through a middle member 414. These channels 406, 416 can be any length, size or shape, any array or configuration, and suitably spaced so that the structure 400 is not compromised, but rather enough air and fluid flow is created for best function. In one embodiment, the upper 410 and lower 412 arches are covered with an array of tufts of bristles placed with the alignment of the teeth close enough to ensure that no tooth or embrasure is missed, because of the channels 406. The vertical channels 416 connect the upper 410 and lower 412 arches for fluid and air flow. They can be in any array and any shape. Shorter bristle tufts 420 are at angles to reach parts of the teeth that might have been missed because of the channels 406, 416. The channel 416 connecting the upper 410 and lower 412 arches make it possible for fluid to easily flow and drain. The appliance 40 is made of pliable plastic or injected FDA approved material that can have infused bristles and is sturdy enough to keep its shape, with some cut out shapes creating channels. It can be in a single color or multiple colors. In one embodiment, an array 430 of longer bristle tufts in various directions so that they cover or overlap, so that all the teeth get brushed thoroughly.

Figure 5:
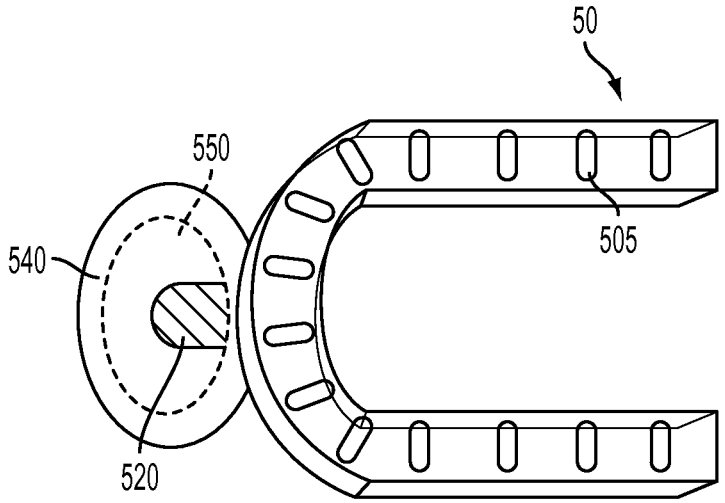
FIG. 5 illustrates a top view of one embodiment of an appliance incorporating aspects of the present disclosure.
Figure 6:
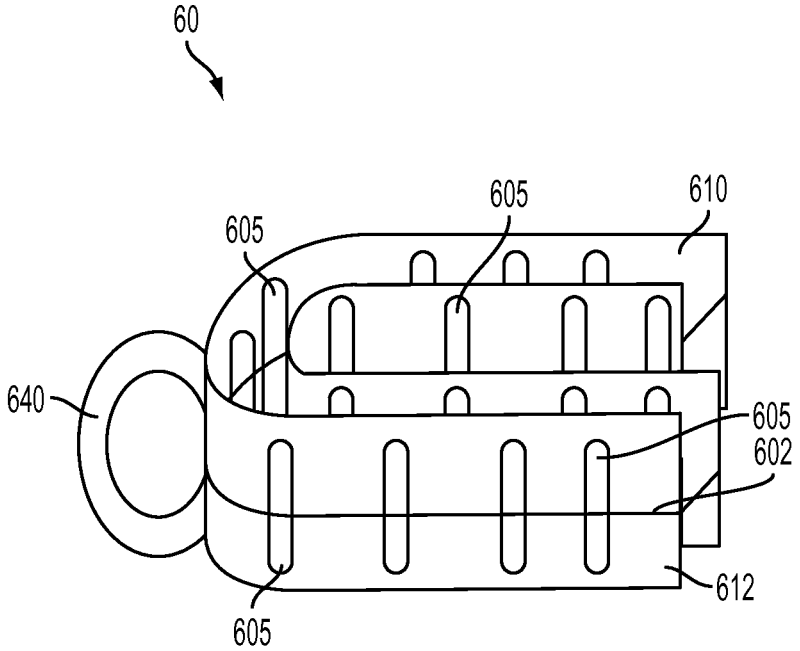
FIG. 6 illustrates a side view of one embodiment of an appliance incorporating aspects of the present disclosure.

FIG. 5 HANDLE Top/Bottom view (same) illustrates a top view of one embodiment of an appliance 50 incorporating aspects of the present disclosure. In this embodiment, the appliance 50 includes the handle. The handle is made so that either the inner portion, 550,520 can be removed to allow for a larger opening to allow for a finger or thumb to grab, or for the outer portion, 540 to be removed if a larger grasp is not needed, or just a thumb grip 520. By perforating the molded material it can be altered easily so that there can be a larger handle which will allow a finger to be inserted, or the outer portion can be removed to leave a smaller less protrusive handle, Also showing top/bottom view, array of channels 505, on the biting surface connecting the upper and lower arches.

FIG. 6. Side View

Showing the larger handle with the perforated portions of the center removed so stroke victims can insert a finger or two to use. Horizontal channels 605 can be placed in any array at equally or sporatic spacing to allow for air and fluids to flow properly. In this version the upper 610 and lower 612 arches have channels 605 in line on either side of the midline or biting surface 602.

Figure 7:
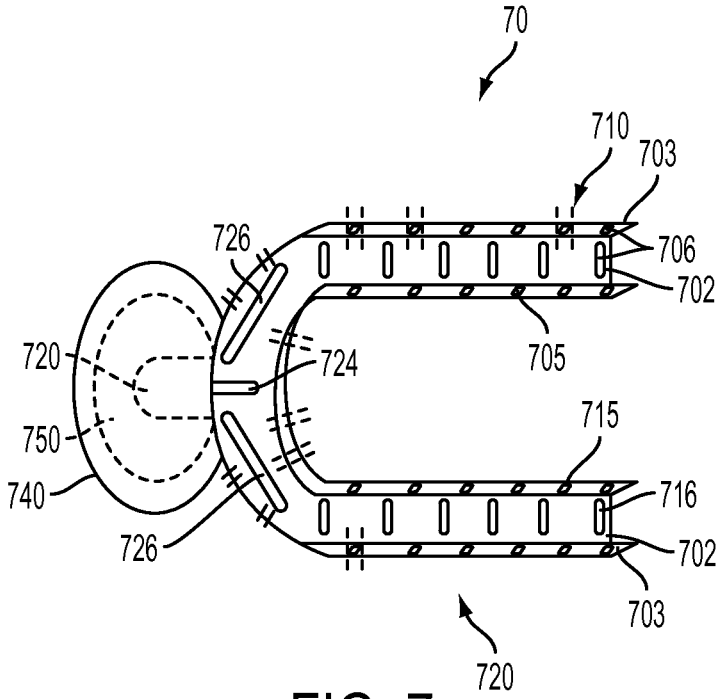
FIG. 7 illustrates a top view of another embodiment of an oral appliance incorporating aspects of the present disclosure.
Figure 8:
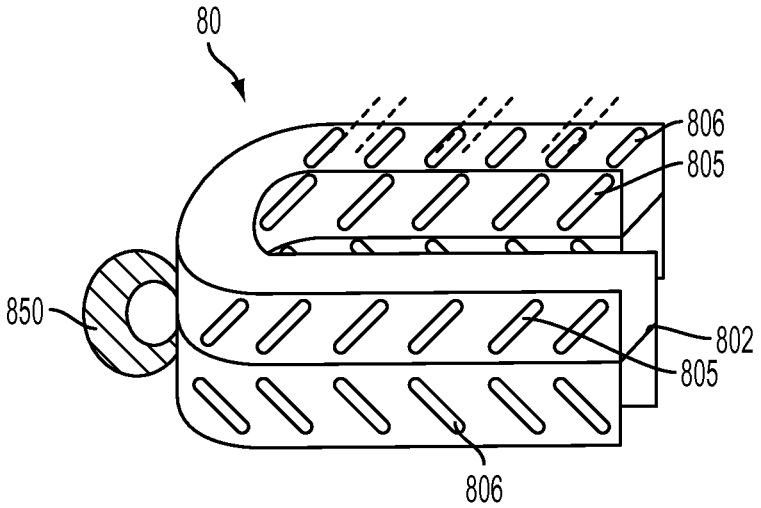
FIG. 8 illustrates an exemplary channel arrangement in an oral appliance incorporating aspects of the present disclosure.

FIG. 7 illustrates a top view of one embodiment of an appliance 70 incorporating aspects of the present disclosure. In this embodiment, the appliance 70 includes an alternating arrangement of channels 705. The substantially vertically aligned channels 706 extend through the biting surface 702 and are not generally in alignment with the substantially horizontally aligned channels 705 through the sides 703.

In one embodiment, the appliance 70 can also include coinciding channels 715, 715 that generally are in alignment with each other. In the example of FIG. 7, one side 710 of the appliance 70 is configured with a staggered arrangement of channels 705, 706, while the other side 720 is configured with a coinciding arrangement of channels 715, 716. In alternate embodiments, both sides 710, 720 can be arranged in the same or similar manner.

In one embodiment, the appliance 70 can include anterior channels 726, that can be alike or differ from the channels 705, 706, 715, 716 shown in FIG. 7.

The handle with all the perforations and possibilities in place 720, 740, 750.

FIG. 8

Another representation of the possibilities that channels 805, 806 that can have. These channels 805, 806 in the bite surface and sidewalls, respectively, are placed at an angle and looks like a leafy vine.

The middle of the handle retained 850, it has an opening but is not as large as it could be, and it can be used for smaller hands.

Figure 9:
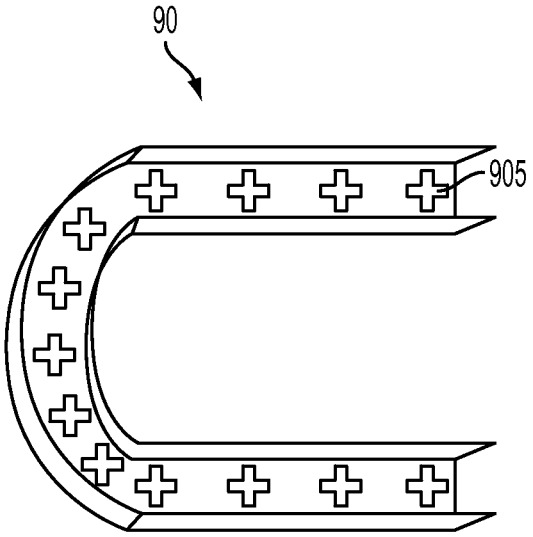
FIG. 9 illustrates another exemplary channel arrangement in an oral appliance incorporating aspects of the present disclosure.
Figure 10:
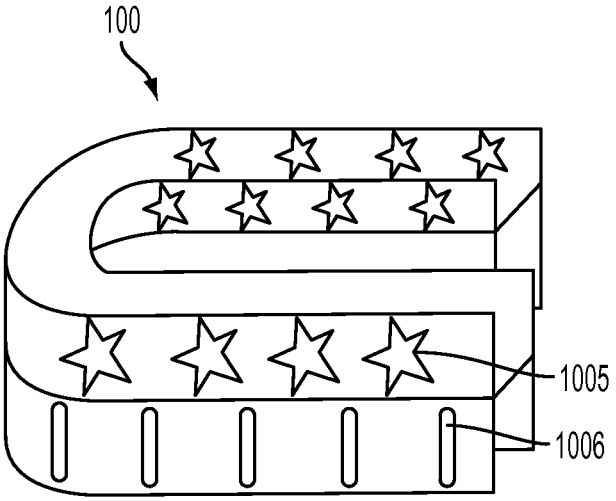
FIG. 10 illustrates an exemplary channel arrangement in an oral appliance incorporating aspects of the present disclosure.

FIG. 9 Top/Bottom View

Another configuration of channels 905, this same shape can be used on the sides as well. I would like to make this one in white, and the gums and tongue being reddish would be like the Red Cross.

FIG. 10 Side View

This represents any shape and configuration can be used, here I chose stars and strips for the shape of the channels 1005, 1006; fun for younger users or perhaps the military. I would like this made in blue where the stars are, and white where the vertical channels so that the top would be blue and the bottom would be white, the gums and tongue are red. These are just a few of the possibilities, some others are lightning bolts, Christmas tree, rocket ship, half moon, perhaps the batman symbol, anything to help children get through this chore more easily.

Incorporating spaces/channels into the structure is what makes this appliance viable and functional. To keep three generic sizes, small, medium and large, will keep the cost of the individual item reasonable. It can be made in any color or array of colors, and have a handle that can be tailored to individual needs. Ideally I would like to have insurance cover the cost for severely disabled. An appliance that is easy to administer and easily used by developmentally challenged and disabled opens the possibilities of having dental care for these patients easy and possible.

What is claimed is:

1. A tooth brush appliance, comprising:

a frame including an upper arch member and a lower arch member configured to receive teeth, the upper arch member and lower arch member including bristle members;

an inner sidewall and an outer sidewall of the upper arch member including one or more openings, the one or more openings defining a first set of channels extending through the inner sidewall and outer sidewall of the upper arch member; an inner sidewall and an outer sidewall of the lower arch member including one or more openings, the one or more openings defining a second set of channels extending through the inner sidewall and outer sidewall of the lower arch member, and wherein each a channel from the first set of channels extends along the inner sidewall and the outer sidewall from a top portion of the upper arch member to a bottom portion of the upper arch member and each channel from the second set of channels extends along the inner sidewall and the outer sidewall from a top portion of the lower arch member to a bottom portion of the lower arch member.

2. The tooth brush appliance of claim 1, comprising a connecting member coupling the upper arch member and the lower arch member, the connecting member including one or more openings defining channels extending through the connecting member.

3. The tooth brush appliance of claim 2, wherein the channels extending through the connecting member are disposed substantially vertically.

4. The tooth brush appliance of claim 1, wherein the first set of channels extending through the upper arch member and the second set of channels extending through the lower arch member are disposed in a staggered relationship relative to one another.

5. The tooth brush appliance of claim 1, wherein the first set of channels extending through the upper arch member and the second set of channels extending through the lower arch member are substantially oval shaped.

6. The tooth brush appliance of claim 5, wherein the substantially oval shaped channels extending through the upper arch member and the substantially oval channels extending through the lower arch member are angled relative to one another.

7. The tooth brush appliance of claim 1, comprising a handle member.

8. The tooth brush appliance of claim 1, wherein the upper arch member is configured to engage an upper row of teeth for brushing and the lower arch member is configured to engage a lower row of teeth for brushing.

9. The tooth brush appliance of claim 1, wherein the appliance is configured to substantially simultaneously engage all teeth in mouth for brushing.

10. A full mouth tooth brush appliance, comprising:

an upper arch member;

a lower arch member;

a coupling member coupling the upper arch member to the lower arch member; bristle members coupled to the upper arch member and the lower arch member configured to engage teeth in a mouth for brushing;

one or more openings in sidewalls of the upper arch member and the lower arch member, the one or more openings defining a first set of channels extending through the sidewalls of the upper arch member and the lower arch member;

one or more openings defining a second set of channels extending through the coupling member, the first set of channels extending through the sidewalls of the upper arch member and the sidewalls of the lower arch member being disposed at an angle relative to the second set of channels extending through the coupling member; and a set of anterior channels in a forward portion of the appliance extending through the coupling member, the anterior channels comprising a substantially oblong shape.

11. The full mouth toothbrush of claim 10, wherein the first set of channels extending through the sidewalls of the upper arch member and the lower arch member are fluidly coupled to the second set of channels extending through the coupling member.

12. The full mouth toothbrush of claim 10, wherein the first set of channels extending through the sidewalls of the upper arch member and the lower arch member are oriented along a substantially horizontal plane and the second set of channels extending through the coupling member are oriented along a substantially vertical plane relative to the channels extending through the sidewalls of the upper arch member and the lower arch member.

13. The full mouth tooth brush of claim 10, wherein a structure of the full-mouth tooth brush is substantially H-shaped.

14. The full mouth tooth brush of claim 10, wherein a structure of the full mouth tooth brush is substantially U-shaped.

15. The full mouth tooth brush of claim 10, wherein the first set of channels are configured in a staggered arrangement in the sidewalls relative to a location of the second set of channels in the coupling member.

16. The full mouth tooth brush of claim 10, wherein a shape of a channel in the first set of channels and a shape of a channel in the second set of channels is substantially oval.

17. The full mouth tooth brush of claim 10, wherein the handle is formed from the same material or mold, and divided into three parts by perforations.

* * * * *